United States Patent [19]

Bennett

[11] 4,182,469

[45] Jan. 8, 1980

[54] SLING DEVICE FOR A RIFLE OR THE LIKE

[76] Inventor: Herman W. Bennett, 8777 Fowler Ave., Omaha, Nebr. 68134

[21] Appl. No.: 895,537

[22] Filed: Apr. 12, 1978

[51] Int. Cl.[2] ..... F41C 33/00

[52] U.S. Cl. ..... 224/150; 224/913

[58] Field of Search ..... 224/1 A, 1 R, 5 V, 5 R, 224/2 A, 150, 913, 5 A, 5 B, 26 R, 26 B, 5 S, 5 H, 5 P, 5 BC; 24/2.5; 42/85

[56] References Cited

U.S. PATENT DOCUMENTS

| | | | |
|---|---|---|---|
| 1,396,270 | 11/1921 | Grierson | 224/1 A |
| 3,441,185 | 4/1969 | Moomaw | 224/1 R |
| 3,495,770 | 2/1970 | Seltmann et al. | 224/1 A |

*Primary Examiner*—Jerold M. Forsberg
*Attorney, Agent, or Firm*—Zarley, McKee, Thomte, Voorhees & Sease

[57] ABSTRACT

A sling device for a rifle or the like comprising first and second elongated flexible straps each having first and second ends. The first ends of the flexible straps are adjustably secured together by means of adjustment hooks. The other end of the second strap has a D-ring mounted thereon which is slidably mounted on the first strap. The second end of the first strap has a post screw extending through a U-shaped portion of the first strap. A snap lock strap is secured to the post screw and has a snap lock mounted thereon which may be detachably secured to the second end of the second strap to maintain the second strap in position relative to the first strap. With the snap lock fastened, the sling may be used in conventional fashion or may be used by separating the straps to permit the rifle to be slung diagonally across the chest of the hunter. With the snap lock unfastened, the rifle may be raised to the shooting position.

2 Claims, 8 Drawing Figures

SLING DEVICE FOR A RIFLE OR THE LIKE

BACKGROUND OF THE INVENTION

This invention relates to a sling device and more particularly to a sling device for a rifle or shotgun.

Many types of sling devices have been provided for conveniently carrying a rifle or shotgun and for supporting the weapon in position during firing. The weapon is normally slung over a shoulder or diagonally across the back of the shooter when the weapon is being carried. With the weapon slung over a person's shoulder, one hand must be used to maintain the weapon on the shoulder and this is difficult while hiking, riding horseback or trailbikes. If the weapon is slung diagonally across the back of the shooter, it is practically impossible to quickly remove the weapon from the slung position to enable the person to shoot.

Therefore, it is a principal object of the invention to provide an improved sling device for a rifle or the like.

A further object of the invention is to provide a sling device for a rifle or the like which may be used in conventional fashion and which may be used in a manner slung diagonally across the chest of the shooter.

A still further object of the invention is to provide a sling device which permits a weapon to be slung diagonally across the chest of the shooter and which may be quickly moved upwardly into shooting position.

A still further object of the invention is to provide a sling device which may be easily attached to rifles or the like having front and rear sling swivels.

A still further object of the invention is to provide a sling device which is economical of manufacture, durable in use and refined in appearance.

These and other objects will be apparent to those skilled in the art.

SUMMARY OF THE INVENTION

Figure 1:
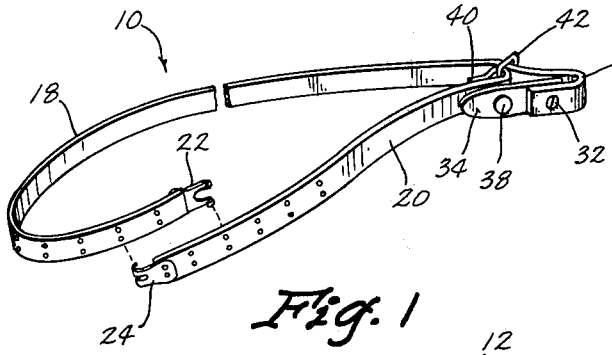
FIG. 1 is a partial perspective view of the sling of this invention.
Figure 2:
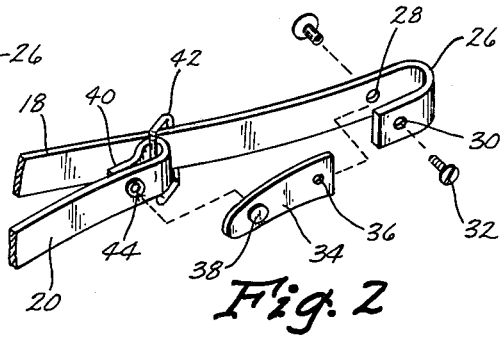
FIG. 2 is a partial exploded perspective view of one end of a sling.
Figure 3:
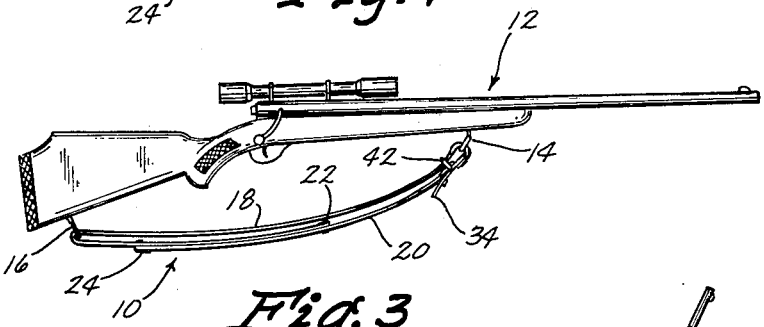
FIG. 3 is a side view of a rifle having the sling mounted thereon.

The sling comprises first and second strap members having one end thereof adjustably secured together by means of adjustment hooks. The other end of the first strap is provided with a U-shaped portion which is secured to the front sling swivel of the weapon by means of a post screw. A short snap strap is also secured to the post screw and has a fastener element mounted thereon. The other end of the second strap has a D-ring secured thereto which is selectively slidably mounted on the first strap between the ends thereof. A fastener element is also provided on the second end of the second strap for detachable attachment to the snap strap. With the snap strap fastened to the second end of the second strap, the weapon may be slung across the shooter's back or over the shoulder in conventional fashion. When it is desired to sling the weapon across the chest of the hunter, the weapon is held vertically in front of the shooter with the sling on the side of the shooting arm. The shooting hand is then used to separate the two straps to form a loop. The loop is slipped over the head and shoulder of the person so that the weapon is positioned diagonally across the chest of the hunter. The snap lock is normally left fastened during hiking, walking, etc. When the hunter anticipates firing, the snap lock is unfastened although the weapon remains slung diagonally across the chest of the hunter. To shoot, the hunter grasps the rifle by the pistol grip and the fore-end and raises the rifle while rotating it slightly thereby pushing the weapon forward into the shooting position. As the weapon is moved into the shooting position, the D-ring slides on the first strap.

DESCRIPTION OF THE PREFERRED EMBODIMENT

The numeral 10 of this invention refers generally to a rifle or shotgun of this invention while the numeral 12 refers to a conventional rifle having a front sling swivel 14 and a rear swing swivel 16. Generally speaking, the rear sling swivel 16 is positioned at the butt end of the rifle while the front sling swivel 14 is positioned adjacent the fore-end of the rifle.

Sling 10 generally includes straps 18 and 20 adjustably connected together by means of adjustment hooks 22 and 24. However, it should be noted that the adjustment hooks are merely provided for convenience and straps 18 and 20 could be a single strap if desired.

Strap 18 has the adjustment hook 22 at one end thereof and has its other end bent into a U-shaped portion 26 having openings 28 and 30 formed therein which normally receive the post screw referred to generally by the reference numeral 32 as will be described in more detail hereinafter. Snap strap 34 has an opening 36 formed at one end thereof which receives the post screw 32 as illustrated in the drawings. The other end of strap 34 is provided with a snap lock 38.

Strap 20 has the adjustment hook 24 at one end thereof and has its other end bent or folded upon itself to form the U-shaped portion 40 having a D-ring 42 positioned therein. U-shaped portion 40 is maintained in its closed position by a snap-rivet 44. As seen in the drawings, D-ring 42 is selectively slidably mounted on the strap 18.

The strap 10 is initially mounted on the rifle 12 as follows. The post screw 32 is removed from the U-shaped portion 26 of strap 18 to permit strap 18 to be removed from the D-ring 42. The post screw end of the strap 18 is then extended through the rear sling swivel 16 from back to front with the smooth side of the leather next to the rifle. The post screw end of the strap 18 is then threaded through the D-ring 42. The post screw end of strap 18 is then extended through the front sling swivel 14 halfway between the post screw openings 28 and 30. The snap strap 34 is then positioned between the openings 28 and 30 and the post screw 32 is then extended through the openings 30, 36 and 28 and tightened. Snap lock 38 is normally left attached to the snap-rivet 44 during the installation just described.

Figure 4:
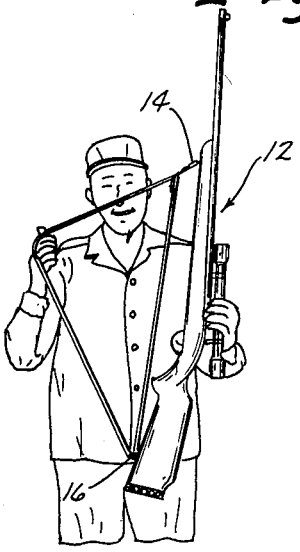
FIGS. 4, 5 and 6 are frontal views of a shooter illustrating the sequence in slinging the rifle.
Figure 5:
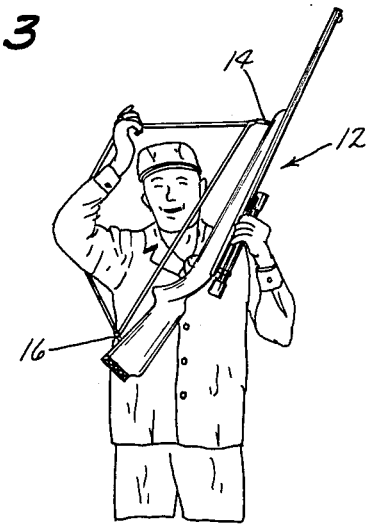
Figure 6:
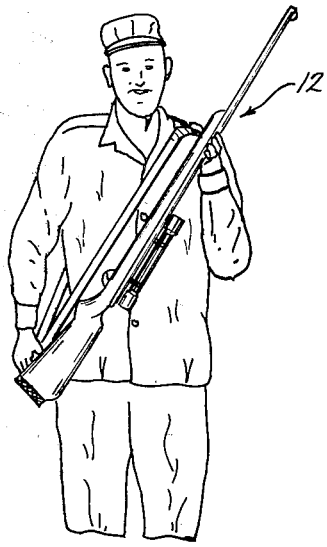
Figure 7:
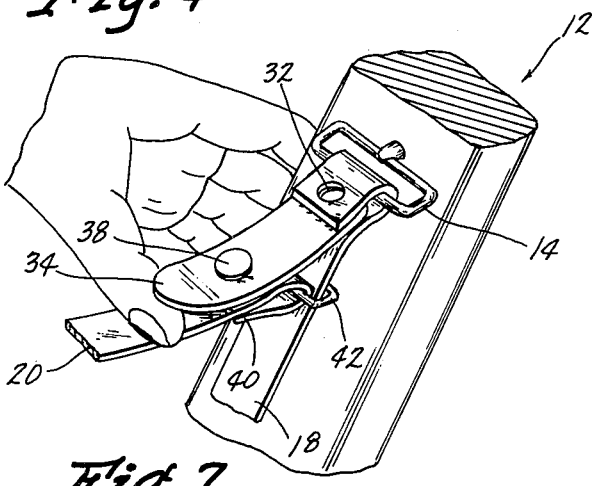
FIG. 7 is a perspective view illustrating the manner in which the snap lock is unfastened.
Figure 8:
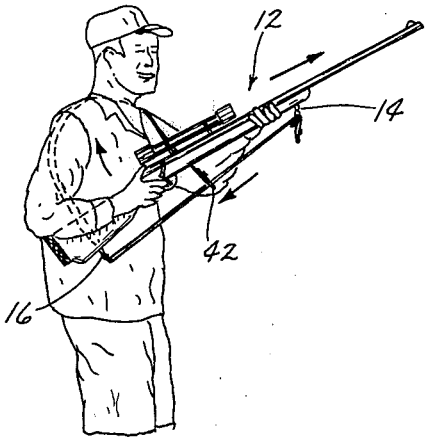
FIG. 8 is a side view of a shooter raising the rifle into position.

The snap lock 38 is normally fastened to snap-rivet 44 and the rifle can be carried in all the positions possible with the standard military sling or carrying strap. When it is desired to utilize the sling in the preferred fashion, the rifle is held vertically in front with the barrel up as shown in FIG. 4. The sling is positioned on the side from which the persons shoots. Using the shooting hand to separate the two straps as shown in FIG. 4, the rifle is raised and the shooting arm is slipped through the loop formed by the two straps as illustrated in FIG. 5. The loop is slipped over the head and the short strap 20 slides down diagonally across the back. The rifle is then lowered and adjusted into the most comfortable position such as seen in FIG. 6. With the rifle in the position illustrated in FIG. 6, both hands are free to walk, ride horseback or ride trailbikes. When hunting, the snap lock 38 is unfastened from snap-rivet 44 (FIG. 7). However, the rifle remains in the position of FIG. 6 even though the snap lock has been unfastened. To shoot, the person grasps the rifle by the pistol grip and the fore-end, raises the rifle and rotates it slightly and pushes it forward into the shooting position. The D-ring 42 slides on the strap 18 to permit the rifle to be moved upwardly and forwardly such as depicted in FIG. 8.

Thus it can be seen that a novel sling has been provided for a rifle or the like which permits the rifle to be safely carried by the hunter while yet permitting the hunter to rapidly raise and use the rifle should the occasion arise. Thus it can be seen that the device accomplishes at least all of its stated objectives.

I claim:

1. A sling device for a weapon having fore and butt ends, comprising, a first elongated flexible strap having first and second ends, a second elongated flexible strap having first and second ends, said first ends of said first and second straps being adjustably secured together, a ring means selectively slidably mounted on said first strap, said second end of said second strap being secured to said ring means, said first strap being selectively adjustably secured to the weapon adjacent the butt end thereof, said first strap having a U-shaped portion which is secured to the weapon adjacent the fore-end thereof, and fastener means selectively securing said second end of said second strap to said first strap adjacent said U-shaped portion, wherein said U-shaped portion is secured to said weapon by a screw means extending through said U-shaped portion and said fastener means comprising a first snap fastener element mounted on said second end of said second strap, a snap strap secured to said screw means and extending therefrom, and a second snap fastener element on said snap strap for connection to said first snap fastener element.

2. In combination with a gun having fore and butt ends and a rectangular shaped strap receiving ring member secured to the fore and butt ends thereof respectively, a first elongated flexible strap having first and second ends, a second elongated flexible strap having first and second ends, said first ends of said first and second straps being adjustably secured together, a ring means selectively slidably mounted on said first strap, said second end of said second strap being secured to said ring means, at least one end of said first strap having a configuration such that it can be extended through the ring member on the butt end of the gun, said first strap being received by the ring member on the butt end of the gun, said first strap having a U-shaped portion at its second end which can be extended through the ring member on the fore end of the gun, a removable screw means extending through said U-shaped portion of said first strap to secure said U-shaped portion to the ring member on the fore end of the gun, a snap strap having one end secured to said screw means and having a first snap fastener element mounted on its other end, a second strap fastener element on said second strap adjacent the second end thereof adapted to have said first snap fastener element selectively, secured thereto whereby said second end of said second strap will be held in position relative to said first strap.

* * * * *